US006012941A

United States Patent [19]

Burdenko et al.

[11] Patent Number: 6,012,941

[45] Date of Patent: Jan. 11, 2000

[54] ELECTRIC CABLE ACCESS PREVENTION DEVICE

[76] Inventors: Igor Burdenko, 34 Joice Rd., Wayland, Mass. 01778; Mark Gorokhovsky, 490-33rd Ave., Apt. 206, San Francisco, Calif. 94121; Alexander Shkolnik, 480 Dartmouth Ave., San Carlos, Calif. 94070

[21] Appl. No.: 09/196,893

[22] Filed: Nov. 19, 1998

[51] Int. Cl.[7] ..... H01R 13/62

[52] U.S. Cl. ..... 439/373; 439/133; 439/135; 439/304; 439/373; 174/67; 70/58

[58] Field of Search ..... 439/304, 133, 439/135, 373; 174/66, 67; 70/58

[56] References Cited

U.S. PATENT DOCUMENTS

| | | | |
|---|---|---|---|
| 2,462,756 | 2/1949 | Leopold | 439/135 |
| 4,488,764 | 12/1984 | Pfenning et al. | 339/37 |
| 4,674,813 | 6/1987 | Feldmer | 439/133 |
| 4,846,708 | 7/1989 | Marson et al. | 439/133 |
| 4,898,009 | 2/1990 | Lakoski et al. | 70/58 |
| 5,026,300 | 6/1991 | Varner | 439/371 |
| 5,045,640 | 9/1991 | Riceman | 174/67 |
| 5,139,429 | 8/1992 | Herman et al. | 439/133 |
| 5,190,466 | 3/1993 | McVey . | |
| 5,338,211 | 8/1994 | Kodama et al. | 439/135 |
| 5,589,665 | 12/1996 | Scamacca | 174/67 |
| 5,731,763 | 3/1998 | Herweck et al. . | |
| 5,795,176 | 8/1998 | Blaetz | 439/373 |
| 5,911,586 | 6/1999 | Wintergerst | 439/133 |

*Primary Examiner*—Paula Bradley
*Assistant Examiner*—Truc Nguyen

[57] ABSTRACT

A set of two locking devices for permanently securing in place a detachable socket of an electric power supply cable and for preventing access to the electric plug on the opposite end of the cable. Both devices are locked by the same key which is used for tightening bolts on the locking device of the socket and for locking a box-like enclosure around the plug. The set is intended for preventing access of unauthorized individuals to electric appliances, instruments and devices. It is also intended for limiting access by children to electric appliances, as well as to television and video games in the absence of parental supervision.

28 Claims, 4 Drawing Sheets

ELECTRIC CABLE ACCESS PREVENTION DEVICE

FIELD OF THE INVENTION

The present invention relates to electric cable connectors and more particularly to devices which prevent unauthorized access to electric appliances, domestic video games, television or personal computer video displays, or the like.

DETAILED DESCRIPTION OF THE INVENTION

A general problem associated with home television, video games, and computers is that each of these devices, while offering opportunities for education, entertainment and cultural enrichment, can, through fascination or boredom, occupy children for an inordinate period of time or proportion of their time, and detract a child's attention from other useful activities and growth in their life. Accordingly, parents generally limit access to television and video games. However, in some cases children become so addicted to television, video games, and the Internet that they sometimes spent more than 10 hours a day with these devices, when the parents cannot control access to these activities.

Extensive psychological tests conducted with people who spend many hours watching TV and, especially, communicating with their "friends" via the Internet without ever seeing them, showed that that long-hours on the Internet can deteriorate the personality of such people, cause detriment to familial relationships, and even lead to loneliness.

What is even more troubling, and possibly even dangerous, is that without proper parental supervision, children may have access to electrical domestic appliances such as electric irons or similar devices. While playing with these devices, children may start a fire or may damage the appliances. This problem may have wider application since unauthorized use of electric appliances, devices and instruments concerns not only children, but adults as well. For example, management of some companies or educational institutions may not always be able to control access to copying machines, printers, and computers in the offices or other facilities during non-working hours when unauthorized individuals may use them, e.g., use the copying machines for personal purposes.

Attempts have been made to prevent access to video games, TV sets, and computers by utilizing a special access controller. One such device is described in U.S. Pat. No. 5,731,763 issued in Mar. 24, 1998 to S. Herweck, et al. This device consists generally of two parts, i.e., a wireless transmitter and a receiving unit. The receiving unit has a tamper-proof housing that covers the device power line and protects receiving and switching circuitry. The receiving circuitry receives and demodulates a control signal sent by the transmitter, and drives the switching circuitry between ON and OFF states. In a preferred embodiment, the housing has opposing halves which close about the device plug. A pigtail line cord extends from the housing and provides power through the switch, to the device plug. The idea of this patented device is to conceal the presence and operation of the switch from discovery, preventing behavioral problems associated with parent-child enforcement situation.

A disadvantage of the device described U.S. Pat. No. 5,731,763 is that it is complicated in construction and expensive to manufacture. It may be intended for use only with very small children (a six year old child may quickly understand the trick) and only with devices having one end of the cable permanently attached to the device, e.g., to the TV set. This is because in the majority of cases computer monitors are connected to the power supply and to the system unit via a removable electric cable or cord, and older children are smart enough to replace such a cable in the absence of parents. Furthermore, the cable access device of U.S. Pat. No. 5,731,763 has limited use as it is not removable and is built into the cable. Many standard appliances and devices are supplied with a supply cable permanently connected to them. Therefore, in order to utilize the device of U.S. Pat. No. 5,731,763, the existing cable has to be disconnected and replaced with a special cable having the aforementioned device built into it.

An attempt to partially solve the above problem was made by means of a device disclosed in U.S. Pat. No. 5,190,466 issued in 1993 to J. McVey. This patent discloses a locking connector for a detachable power cable. The device can be selectively locked in a standard power socket of an electric power appliance or device utilizing a detachable cable, such as a personal computer or a desk-top laser printer. The device is permanently connected to the socket-side of the electric power supply cable and is made in the form of a large rectangular housing having the socket portion in the form of a conventional socket-side of the detachable cable used for connecting to electric contacts of the computer or other appliance or device. The mechanism has a key-operated spring-loaded inclined sharpened tip or blade which, after fitting the plug portion on the prongs of the electric connections of the device, is pushed out by rotation of the key to a position which prevents disconnection of the plug from the socket.

A disadvantage of this device is that it is complicated in construction, large in size, and expensive to manufacture. The device is permanently connected to the cable, i.e., can be used only with the special electric power supply cable which accommodates this locking device. Another disadvantage is that the sharp blade of the obstructing device may scratch or damage the walls of the socket recess in an attempt to pull the cable our of the socket.

OBJECTS OF THE INVENTION

It is an object of the invention to provide a detachable electric cable access prevention device which is simple in construction, inexpensive to manufacture, simple and universal in use, can be used in conjunction with any standard detachable power supply cable, provides locking of both socket and plug ends of the power supply cable, and has the plug enclosure locked from inside by a single key applicable for both socket and plug ends of the aforementioned cable.

SUMMARY OF THE INVENTION

A set of two locking units, one for permanently securing in place a detachable socket of an electric power supply cable and another for preventing an access to the electric plug on the opposite end of the cable. Both units are locked by the same key which is used for tightening bolts on the locking unit of the cable socket and for locking a box-like enclosure around the plug. The set is intended for preventing access to electric appliances, instruments, and devices by unauthorized individuals. It is also intended for limiting the access of children to electric appliances, as well as to television and video games in the absence of parental supervision.

DETAILED DESCRIPTION OF THE PREFERRED EMBODIMENT OF THE ELECTRIC CABLE ACCESS PREVENTION DEVICE

Figure 1:
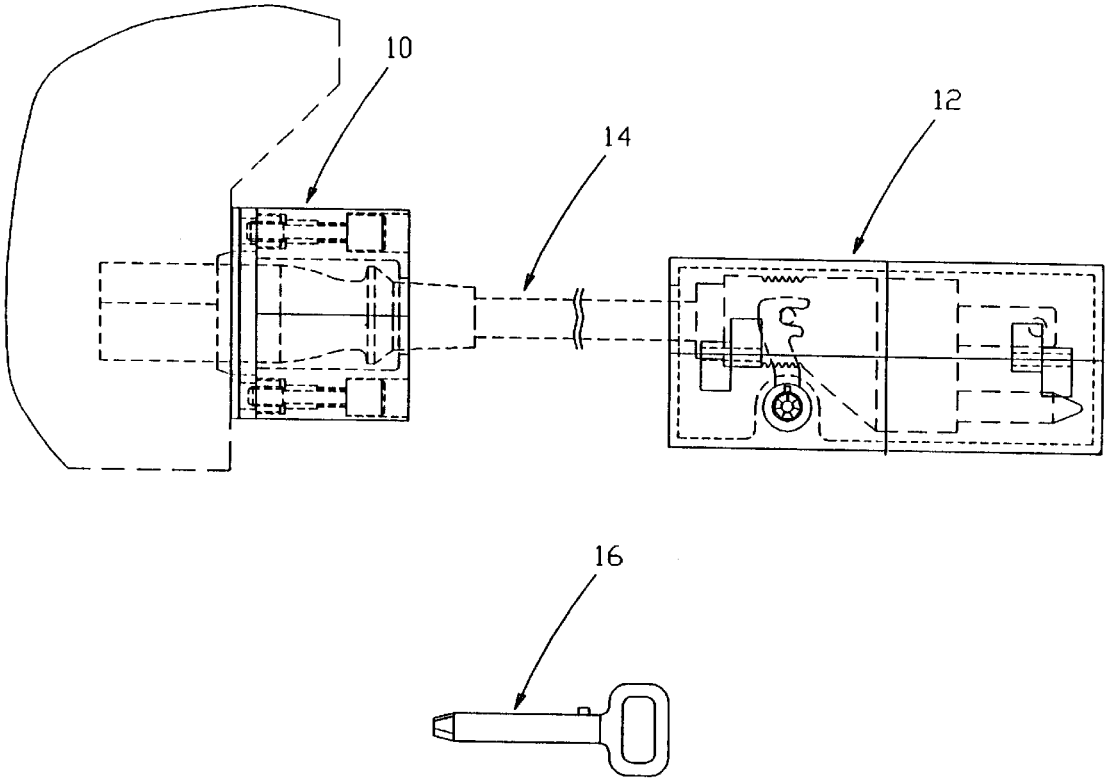
FIG. 1 is a general view of a detachable cable permanently fixed to the socket recess on the back side of the electrical appliance and having the electric plug on the opposite side of the cable locked in a box-like enclosure.

As shown in FIG. 1, which is a general view of an electric cable access prevention device of the present invention, the device of the invention consists generally of two main locking units 10 and 12, which can be attached to and locked on both ends of an electric cable 14 by a common key 16. Locking unit 10 is used for locking those electrical cables which have on the end opposite to the plug a socket portion attachable, e.g., to the electric contact prongs located in a socket recess in the rear side of a computer monitor. Although both units 10 and 12 of the set are separate elements, they constitute an indivisible unity since both these units are locked by a single key and since without the use of socket locking unit 10, application of plug 12 for a detachable electrical cable is useless.

Figure 2:
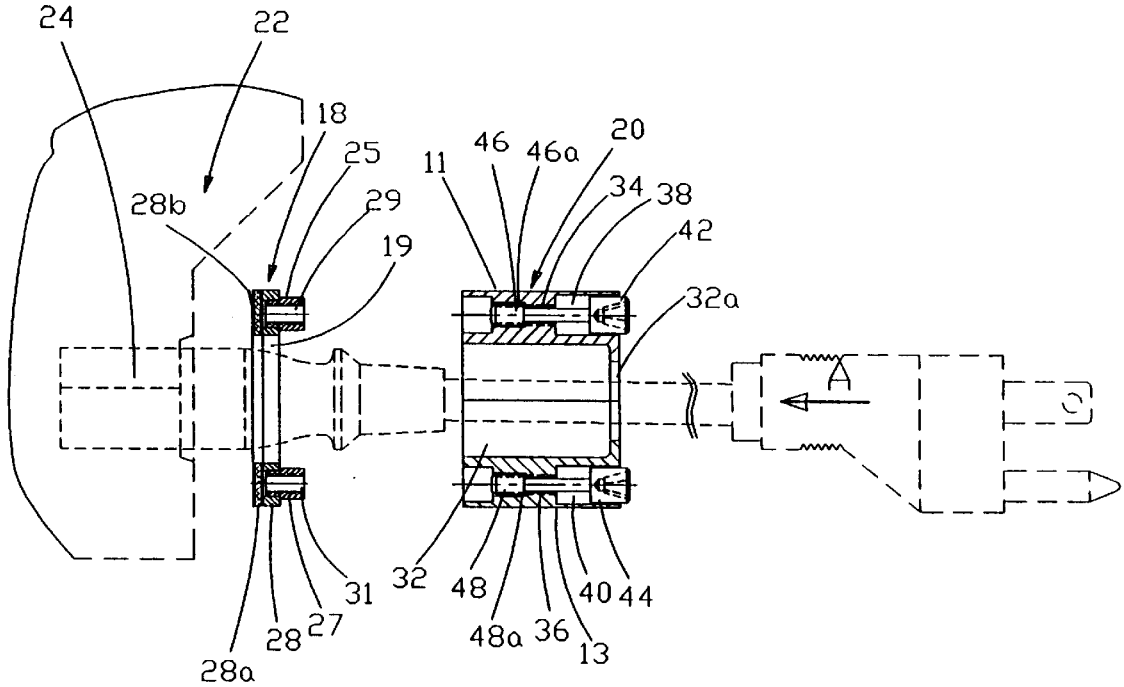
FIG. 2 is an exploded sectional view of a locking unit for permanently securing the socket portion of a detachable cable.

As shown in FIG. 2, an exploded sectional view of locking unit 10 for permanently securing the socket portion of a detachable cable, the unit consists of two parts, i.e., an attachable holder 18 and a socket enclosure 20. Attachable holder 18 has a central opening 19 which is larger than the outer configuration of cable socket 24. On its side facing an electrical appliance 22, attachable holder 18 has a frame-like plate 28. The outer surface of the frame-like plate 28 is coated with a strong adhesive substance 28*a* which is protected and covered by paper or a plastic layer 28*b* that can be peeled back. On the side opposite to electrical appliance 22, attachable holder 18 has metal inserts 25 and 27 with threaded openings, e.g., with two threaded openings 29 and 31.

Figure 2A:
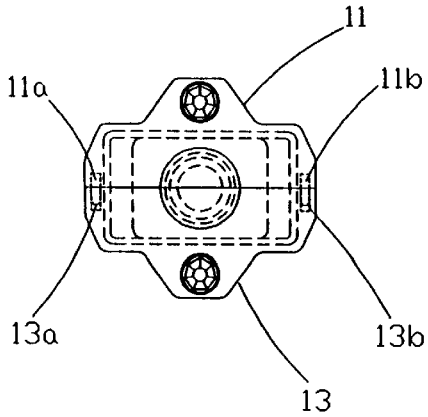
FIG. 2*a* is an end view in the direction of arrow A.

Socket enclosure 20 is made of two halves 11 and 13 shown in FIG. 2*a* which is an end view in the direction of arrow A. As shown in FIG. 2*a*, part 11 has guide pins 11*a* and 11*b*, where part 13 has openings 13*a* and 13*b* for aforementioned pins so that both parts 11 and 13 can be assembled around cord 14 by inserting guide pins 11*a* and 11*b* into respective openings 13*a* and 13*b*. As shown in FIG. 2, in an assembled state, parts 11 and 13 form a cavity 32 of the size greater than the outer configuration of socket portion 24. However, an opening 32*a* formed in the wall of socket enclosure 20 is smaller than socket portion 24 of the cable, but greater than the diameter of cable 14 so that socket portion 24 cannot be pulled out from socket locking unit 10 when this unit is fixed in place (FIGS. 1 and 2).

Socket enclosure 20 has threaded openings 34 and 36. On the side opposite to electrical appliance 22, threaded openings 34 and 36 terminate in cylindrical recesses 38 and 40 for cylindrical heads 42 and 44 of respective screws 46 and 48.

Figure 3:
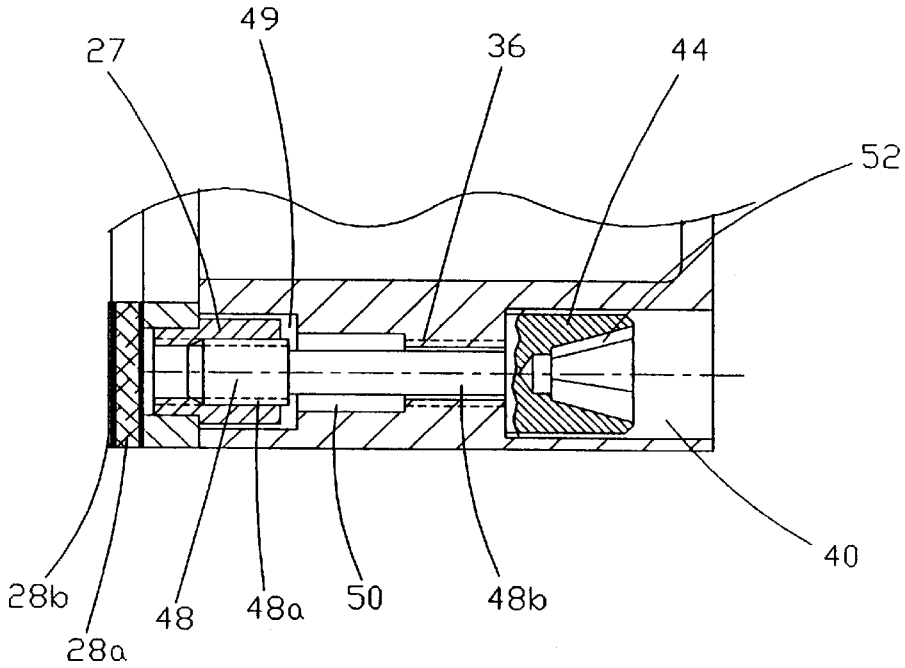
FIG. 3 is an enlarged fragmental sectional view of a unit for locking a cable socket portion in a recess of an electrical appliance.

As shown in more detail in FIG. 3, a fragmental enlarged view of socket locking unit 10, a smooth portion 48*b* which connects threaded portion 48*a* with screw head 44 has a diameter smaller than the inner diameter of a threaded portion 48*a* of screw 48 (screw 46 is not shown in FIG. 3 but it is identical to screw 48). On the side which faces attachable holder 18, socket enclosure 20 has a cylindrical recess 49. Between recess 49 and threaded opening 36, there is a smooth cylindrical opening 50 having a diameter slightly larger than the outer diameter of thread on threaded portion 48*a* of screw 48. Threaded openings 29 and 31 have the same thread and the same arrangement as the thread on threaded portions 46*a* and 48*a* of respective screws 46 and 48. The rear ends of threaded portion 46*a* and 48*a* of the aforementioned screws have no tapering portions and are formed by planes sharply perpendicular to the axis of the screws. As a result, once the threaded portion of screw 46 or 48 passes through threaded opening 34 or 36 into openings 50, this screw cannot be unscrewed back from socket enclosure 20. This is because without the tapered ends the turns of threaded portions 46*a* and 48*a* cannot engage a thread of respective threaded openings 34 and 36. Thus, screws 46 and 48 will remain held in respective halves of socket enclosure 20 (FIG. 2*a*).

As shown in FIG. 3, screw head 44 (and hence screw head 42) has a tapering polygonal recess 52, e.g., of a pentagonal shape, for tightening or untightening the screw with key 16 (FIG. 1) which has a tapering polygonal end 16*a* to fit to tapering polygonal recess 52. Once the screws 46 and 48 are tightened with such a key, it would be impossible, because of the irregular tapered shape of the recess, to unscrew the screws with forceps, screwdrivers, or the like.

It should be noted that tapering polygonal end 16*a* may have any dimensions and cross-sections, preferably irregular, e.g., a pentagonal cross-section.

Figure 4:
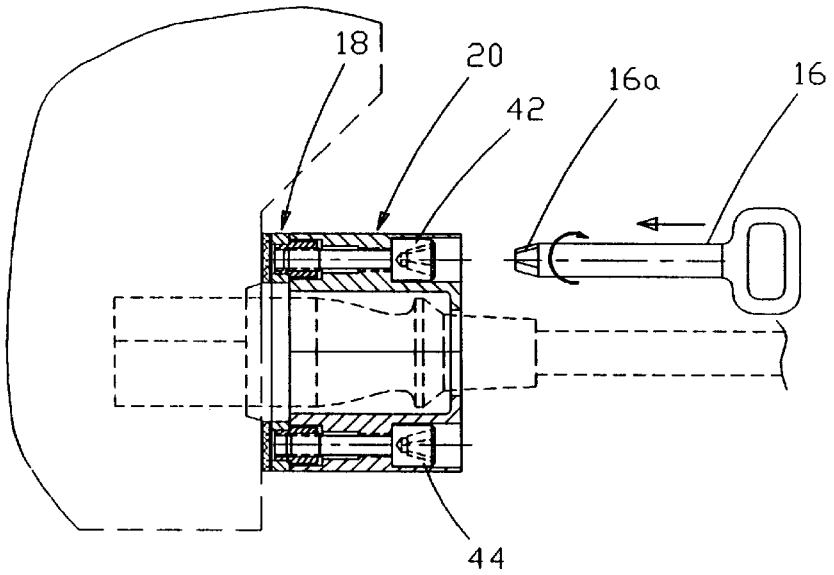
FIG. 4 is a sectional view of the socket locking unit of FIG. 2 in an assembled position with the socket end of the cable fixed to the socket recess.

Socket locking unit 10 is shown in FIG. 4 in an assembled state, in which it is fixed to electric appliance 22, e.g., to the wall of a computer monitor. Further details of FIG. 4 will be described later with reference to the operation of the device of the invention.

All parts of holder 18 (except for metal screws 46 and 48, metal inserts 25 and 27, and metal frame-like plate 28) can be molded from plastic.

Figure 5:
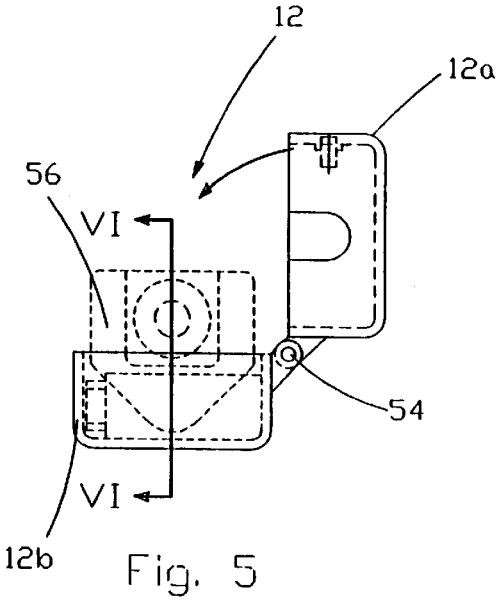
FIG. 5 is a side view of a cable plug locking unit for enclosing the plug end of the cable, the unit being shown in an open position.
Figure 6:
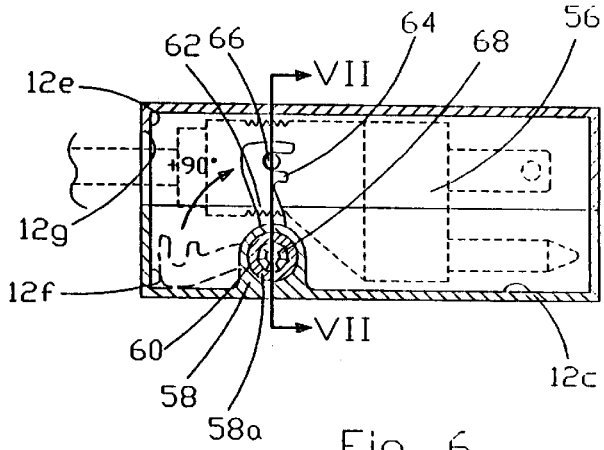
FIG. 6 is a longitudinal sectional view along line VI—VI of the plug locking unit of FIG. 5 in a closed position.
Figure 7:
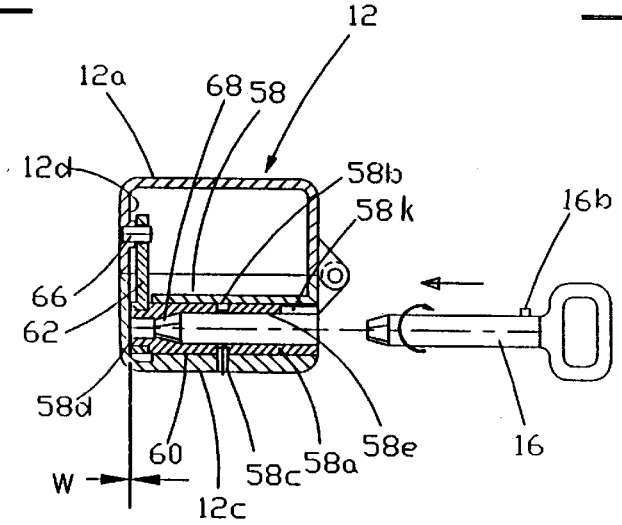
FIG. 7 is a sectional along line VII—VII of FIG. 6.

Plug locking unit 12 will now be described with reference to FIGS. 5 through 7, wherein FIG. 5 is a side view of a locking unit for enclosing the plug end of the cable, the unit being shown in an open position; FIG. 6 is a longitudinal sectional view along line VI—VI of the unit of FIG. 5 in a closed position; and FIG. 7 is a sectional view along line VII—VII of FIG. 6.

Plug locking unit 12 is made in the form of a closable box-like housing which consists of two parts 12*a* and 12*b* connected by a hinge portion 54 (FIG. 5). The interior of box-like housing of plug locking unit 12 is sufficient for placing into it a power supply cable plug of any standard size. Such a plug is designated by reference numeral 56 in FIG. 6.

On its inner bottom side 12*c*, part 12*b* has a semi-cylindrical lug 58 with a through opening 60 for insertion of a metal sleeve 58*a*. Metal sleeve 58*a* has a sliding fit in opening 60 for rotating inside this opening. On its end near an inner wall 12*d* of the box-like housing, metal sleeve 58*a* has a square-shaped cross-section. A lever 62 has a respective square-shaped opening (not shown) to fit onto the square-shaped end of metal sleeve 58*a* for rotating therewith. Sleeve 58*a* has an annular groove 58*b*, and a pin 58*c* is pressed into wall 12*c* so that its end enters groove 58*b* for limiting the insertion of sleeve 58*a* into lug 58 and for defining the width W of a gap 58*d* between the lever 62 and inner wall 12*d* so that once lever 62 is fit onto the end of sleeve 58*a*, the latter cannot be removed from plug locking unit 12 since it will abut against the end of lug 58.

On its free end, lever 62 has a hook 64 which is engageable with a pin 66 attached to the inner wall 12*d* of part 12*a*, so that when hook 64 is engaged with pin 66, the box-like plug locking unit is locked.

Lateral sides 12*e* and 12*f*, which are perpendicular to longitudinal sides of the box-like plug locking unit 12, have openings 12*g* for passing the end of electric power cable 14 connected to plug 56.

Sleeve 58*a* has an opening 58*e* with polygonal tapered opening 68 at the lever-holding end. Polygonal tapered opening 68 has the same geometry and configuration as those of recess 52 (FIG. 3). This means that lever 62 can be turned for engaging hook 64 with pin 66, and hence for locking plug locking unit 12, by means of the same key 16 that is used for tightening screws 44 and 46 on socket locking unit 10. Since tapered end 16*a* has an irregular cross-section, in order to insert key 16 correctly into polygonal tapered opening 68, key 16 has an orientation projection 16*b*, whereas sleeve 58*a* has a respective slot 58*k* for aligning the key end with the recess of the sleeve.

The device of the invention operates as follows:

For preventing access to an electrical appliance energized via a detachable power supply cable of the type shown in FIG. 1, the detachable socket end of the cable should first be permanently fixed to the housing of appliance 22 (FIG. 2). This is a typical cable connection configuration, e.g., on the rear side of a computer monitor. First, socket portion 24 of cable 14 is passed through opening 19 in attachable holder 18, and socket portion 24 is fit onto contact pins (not shown) of electrical appliance 22. Peelable layer 28*b* (FIGS. 2 and 3) is peeled off from frame-like plate 28 on attachable holder 18 for exposing adhesive substance 28*a* of frame-like plate 28. Attachable holder 18 is then firmly pressed to the wall of electrical appliance 22 in a position coaxial with respect to socket portion 24. As a result, attachable holder 18 is firmly attached via adhesion to the electrical appliance.

Once attachable holder 18 is fixed in place, halves 11 and 13 are assembled around cable 14 by inserting pins 11*a* and 11*b* into openings 13*a* and 13*b*. In an assembled state, socket enclosure 20 is connected to attachable holder 18 by screwing screws 46 and 48 into threaded metal inserts 25 and 27. Screws 46 and 48 are tightened by inserting tapered polygonal end 16*a* of key 16 into respective recesses 52 of screw heads 42 and 44, whereby attachable holder 18 and socket enclosure 20 are firmly joined together and fixed to electric appliance 22, thus locking socket portion 24 of power supply cable 14 to the electrical appliance.

Once the socket end of cable 14 is fixed to the electrical appliance, in order to prevent unauthorized use of this appliance, the plug end of the cable has to be closed and locked inside plug locking unit 12. For this purpose, plug 56 is placed into interior of part 12*b* into a position shown in FIG. 5. Box-like plug locking unit 12 is then closed by turning part 12*a* around hinge 54, and plug 56 is locked by turning lever 62 with the use of key 16 for engaging hook 64 with a pin 66 (FIG. 6 and FIG. 7).

As a result, socket 24 is permanently fixed to electric appliance 22, while access of an authorized persons to plug 56 of detachable power supply cord 14 is prevented, until plug locking unit 12 is opened by key 16 which is in the possession of an authorized person.

Figure 8:
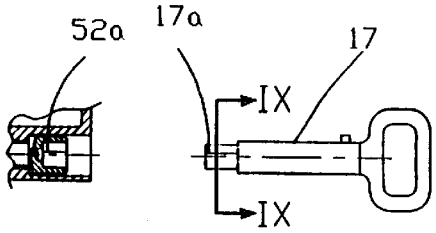
FIG. 8 is a view of a key with a straight polyhedral end of irregular, e.g., pentagonal, configuration.
Figure 9:
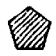
FIG. 9 is an enlarged sectional view along line IX—IX of FIG. 8 illustrating a pentagonal cross-section of the locking end of the key.

It is not necessary that the end of the locking key have a tapering configuration. It may have a straight form of specific size or irregular cross section. FIG. 8 is a view of a key 17 with a straight end 17*a* of pentagonal cross section. FIG. 9 is a sectional view along line IX—IX of FIG. 8 illustrating a cross-section of the locking end 17*a* of the key. In general, key 17 may have a straight configuration of polygonal cross section with dimensions different from dimensions of standardized wrenches for socket head fasteners, or key 17 may have a non-standard cross-section such as, e.g., pentagonal cross-section.

It is understood that mating parts of the cable access prevention device of the invention should have key-engaging portions of the same configuration as key 17. FIG. 8 shows a pentagonal recess 52*a* in the head of a screw 53 for attaching socket enclosure 20 to attachable holder 18. It is understood that key-engaging portion 68 of sleeve 58*a* should have the same configuration as pentagonal recess 52*a* of the screw head.

Thus it has been shown that the invention provides a n electric cable access prevention device which is simple in construction, inexpensive to manufacture, simple and universal in use, can be used in conjunction with any standard detachable power supply cable, provides locking of both socket and plug ends of the power supply cable, and has the plug enclosure locked from inside by a single key applicable for both socket and plug ends of the aforementioned cable.

Although the invention has been shown in the form of a specific embodiments, it is understood that these embodiments were given only as examples and that any changes and modifications are possible, provided they do not depart from the scope of the appended claims. For example, socket locking unit 10 and plug locking unit 12 may have outer configurations different from those shown in the drawings but suitable for specific plugs and sockets. The electric appliance may be an appliance of any type which utilizes a detachable electrical power supply cord. The plug locking unit may be used not necessary for access prevention purposes but also for protection of the plug from mechanical damages, e.g., during transportation, or when the disconnected plug of a long power supply cable lies on the floor. The key and key-engaging recesses of the device may have special dimensions or irregular cross sections.

We claim:

1. An electric cable access prevention device for a detachable cable having a socket portion for connection to an electric appliance on one end and a plug portion for connection to a power supply source on the other end, comprising:

socket enclosure means having an interior sufficient for enclosing said socket portion and an opening in a wall sufficient for passing said cable but insufficient for passing said socket portion, said socket enclosing means consisting of: a connection part which has means for permanently connecting said connection part to said electric appliance; and a locking part for locking said socket portion in said enclosure means, said locking part having at least one fastener means for attaching said locking part to said connection part;

a key for connecting said locking part to said connection part, said key having means for preventing disconnection of said locking part from said connection part; and means for enclosing and locking said plug portion of said detachable cable with said key.

2. The device of claim 1, wherein said means for enclosing and locking said plug comprise:

an openable and closable box-like housing which consists of a first part and a second part which are connected to one another via a hinge, an interior of said openable and closable box-like housing being sufficient for enclosing said plug portion when said box-like housing is in a closed state, said first part and said second part having openings sufficient for passing said cable through said openings but insufficient for removing said plug portion when said means for enclosing and locking are in a closed state;

and means for locking said box-like housing from inside in said closed state by said key.

3. The device of claim 2, wherein said means for permanently connecting said connection part to said electric appliance comprises a frame-like plate with an adhesive substance on the side of said frame-like plate which faces said electrical appliance and a peelable protective layer which covers said adhesive substance, said adhesive substance being constantly attached to said frame-like plate, said frame-like plate having threaded opening.

4. The device of claim 3, wherein said at least one fastener means for attaching said locking part to said connection part comprises a screw engageable with the thread of said threaded opening.

5. The device of claim 4, wherein said key has a polygonal tapered end, said means for preventing disconnection of said locking part from said connection part by means other than said key comprising a polygonal tapered recess matching said polygonal tapered end.

6. The device of claim 5, wherein said polygonal tapered end and said polygonal tapered recess have nonstandard specific cross-sectional configuration.

7. The device of claim 5, wherein said screw has a head and a recess in said head which is identical to said polygonal tapered recess.

8. The device of claim 2, wherein said means for locking said box-like housing in said closed state by said key comprises a pin on one of said parts of said box-like housing and a pivotable lever with a hook engageable with said pin on the other part of said housing for locking said box-like housing in said closed state, said pin and said lever being located inside said box-like housing.

9. The device of claim 8, wherein said pivotable lever has means for engaging with said key for turning said pivotable lever into position of engagement of said hook with said pin.

10. The device of claim 9, wherein said key has a polygonal tapered end, said means for engaging with said key for turning said pivotable lever comprising a sleeve rotatingly installed in said one of said parts of said box-like housing and a polygonal tapered recess matching said polygonal tapered end.

11. The device of claim 10, wherein said means for permanently connecting said connection part to said electric appliance comprises a frame-like plate with an adhesive substance on the side of said frame-like plate which faces said electrical appliance and a peelable protective layer which covers said adhesive substance, said adhesive substance being constantly attached to said frame-like plate, said frame-like plate having threaded opening.

12. The device of claim 11, wherein said at least one fastener means for attaching said locking part to said connection part comprises a screw engageable with the thread of said threaded opening.

13. The device of claim 12, wherein said means for preventing disconnection of said locking part from said connection part by means other than said key comprising a recess identical to said polygonal tapered recess matching said polygonal tapered end.

14. The device of claim 13, wherein said polygonal tapered end and said polygonal tapered recess have nonstandard specific cross-sectional configuration.

15. An electric cable access prevention device for a detachable cable having a socket portion for connection to an electric appliance on one end and a plug portion for connection to a power supply source on the other end, comprising:

socket enclosure means consisting of: a frame-like plate which has, on one side, an adhesive substance for attaching to said electric appliance, said layer being covered with a peelable layer, and, on the other side, metal inserts permanently fixed in said frame-like plate with threaded openings in said metal inserts; and a locking part for locking said socket portion in said enclosure means, said locking means having a couple of screws for attaching said locking part to said connection part by screwing said screws into said threaded openings, said screws having heads with polygonal tapered recesses;

a key for connecting said locking part to said connection part, said key having a polygonal tapered end engageable with said polygonal tapered recesses for tightening said screws; and a box-like openable and closable housing which consists of a first part and a second part, said both parts being pivotally connected via a hinge, in a closed state said box-like housing forming an interior space sufficient for placing said plug portion into said interior space;

and means in said box-like openable and closable housing for closing said housing from inside by said key, in a closed state said housing forming an opening sufficient for passing said cable, but insufficient for removing said plug portion from said box-like housing when said housing is closed.

16. The device of claim 15, wherein said means for locking said box-like housing in said closed state by said key comprises a pin on one of said parts of said box-like housing and a pivotable lever with a hook engageable with said pin on the other part of said housing for locking said box-like housing in said closed state.

17. The device of claim 16, further comprising a sleeve rotatingly installed in one of said parts of said box-like housing, said sleeve having a polygonal tapered recess matching said polygonal tapered end of said key.

18. The device of claim 17, wherein said locking part for locking said socket portion and said box-like housing are made of plastic, said frame-like plate, said sleeve, said bolts, said screws, said lever, and said pin are made of metal.

19. The device of claim 1, wherein said socket enclosure means and said means for enclosing and locking said plug portion of said detachable cable can be used separately or in combination.

20. The device of claim 15, wherein said socket enclosure means and said a box-like openable and closable housing can be used separately or in combination with each other.

21. The device of claim 18, wherein said socket enclosure means and said a box-like openable and closable housing can be used separately or in combination with each other.

22. The device of claim 4, wherein said key has a straight configuration of irregular polygonal cross section, said means for preventing disconnection of said locking part from said connection part by means other than said key comprising a recess matching said configuration and said cross-section of said key.

23. The device of claim 4, wherein said key has a straight configuration of polygonal cross section with dimensions different from dimensions of standardized wrenches for socket head fasteners, said means for preventing disconnection of said locking part from said connection part by means other than said key comprising a recess matching said configuration of said key.

24. The device of claim 23, wherein said screw has a head and a recess in said head which matches said polygonal cross section of said key.

25. The device of claim 24, wherein said means for locking said box-like housing in said closed state by said key comprises a pin on one of said parts of said box-like housing and a pivotable lever with a hook engageable with said pin on the other part of said housing for locking said box-like housing in said closed state, said pin and said lever being located inside said box-like housing.

26. The device of claim 25, wherein said pivotable lever has means for engaging with said key for turning said pivotable lever into position of engagement of said hook with said pin.

27. The device of claim 26, said means for engaging with said key for turning said pivotable lever comprising a sleeve rotatingly installed in said one of said parts of said box-like housing and a polygonal recess matching said configuration of said key.

28. The device of claim 26, wherein said means for permanently connecting said connection part to said electric appliance comprises a frame-like plate with an adhesive substance on the side of said frame-like plate which faces said electrical appliance and a peelable protective layer which covers said adhesive substance, said adhesive substance being constantly attached to said frame-like plate, said frame-like plate having threaded opening.

* * * * *